United States Patent [19]

Przygocki

[11] 4,218,800

[45] Aug. 26, 1980

[54] PLANETARY GRINDER AND POLISHER

[75] Inventor: Witold C. Przygocki, Southfield, Mich.

[73] Assignee: ACME Manufacturing Company, Ferndale, Mich.

[21] Appl. No.: 21,156

[22] Filed: Mar. 16, 1979

[51] Int. Cl.[3] ..... A46B 13/02

[52] U.S. Cl. ..... 15/88; 29/81 H; 51/90

[58] Field of Search ..... 15/88, 104.04; 51/23, 51/80 R, 80 A, 75, 90; 29/81 H

[56] References Cited

U.S. PATENT DOCUMENTS

| | | | |
|---|---|---|---|
| 3,432,971 | 3/1969 | Conti | 51/90 X |
| 3,633,318 | 1/1972 | Olivotto | 51/90 |
| 4,151,625 | 5/1979 | Stevanovich | 15/88 X |

FOREIGN PATENT DOCUMENTS

| | | | |
|---|---|---|---|
| 1300833 | 4/1970 | Fed. Rep. of Germany . | |
| 490198 | 2/1954 | Italy | 15/88 |

*Primary Examiner*—Edward L. Roberts

*Attorney, Agent, or Firm*—Harness, Dickey & Pierce

[57] ABSTRACT

A machine particularly useful for continuously descaling wire and finishing tubular products. The basic machine incorporates a heavy, circular planetary mounting plate having a pair of independently driven finishing brush wheels, mounted thereon which rotate in enagement with the wire being finished and at the same time are rotated in an orbit about the wire by rotation of the planetary mounting plate. The planetary mounting plate is belt driven from an electric motor. The pair of finishing brushes are belt driven from a second electric motor and are provided with an additional outboard mount so that relatively longer wheels may be used. The brushes may be syncronously adjusted with respect to the workpiece without interrupting operation of the machine. Adjustable wire guide and support means are disposed adjacent the bight of the wheels to properly position the workpiece while it is being engaged by the finishing wheels.

3 Claims, 11 Drawing Figures

18
120
14
112
114
116
126
96
122
124
86
92
84
90
100
104
98
16
88
94
50
128
108
110
77
80
54
14
64
62
76
86
74
84
46
70
72
78
56
66
128'
169
68
164
166
174
170
82

PLANETARY GRINDER AND POLISHER

BACKGROUND OF THE INVENTION

Present methods of descaling wire of from ¼" to 2" outside diameter have involved acid pickling and shot blasting.

Also, planetary machines incorporating belt polishers such as disclosed in sales brochure 170-39R2 of Murry-Way Corporation have been used. However, such polishers are relatively slow and for different uses, a transverse speed of the workpiece of about 100 ft/min. as compared to about 400 ft/min. of the present invention.

German Pat. No. 1,300,833 discloses a planetary machine having a pair of grinding wheels mounted on the planetary mounting plate but in which each grinding wheel is driven by an independent electric motor, both of which are mounted on the planetary plate resulting in a cumbersome machine. Also, the grinding wheels are cantilever mounted, thus restricting the length of wheels that can be used and consequent relatively low output.

SUMMARY OF THE INVENTION

According to this invention, a circular or disc shaped planetary mounting plate is mounted on the end of a hollow-spindle which is supported by a main housing and belt driven from an electric motor by an independent drive system.

A pair of brush wheels of substantial length are mounted on the forward face of the planetary mounting plate for orbital rotation with the plate. Each brush wheel is also rotated about its own axis by a belt drive independent of the drive for the planetary plate and from a single second motor.

Improved outboard supports are provided for the brush wheels so that the machine may accommodate wheels of substantially longer, axial length than heretofore and thus increase the output of the machine.

The wire, or other workpiece, is fed into the machine and guided to a position between the facing surfaces of the brushes and then through an opening in the planetary mounting plate and through the hollow main spindle.

The adjustment of the relative relationship of the wheels, or work distance between the wheels, is syncronized so that the work pressure may be uniformly adjusted without interrupting operation of the machine. By this synchronized adjustment the wheels are always rotating about the true center of the mounting plate.

DESCRIPTION OF PREFERRED EMBODIMENT AND BEST MODE OF OPERATION

Figure 1:
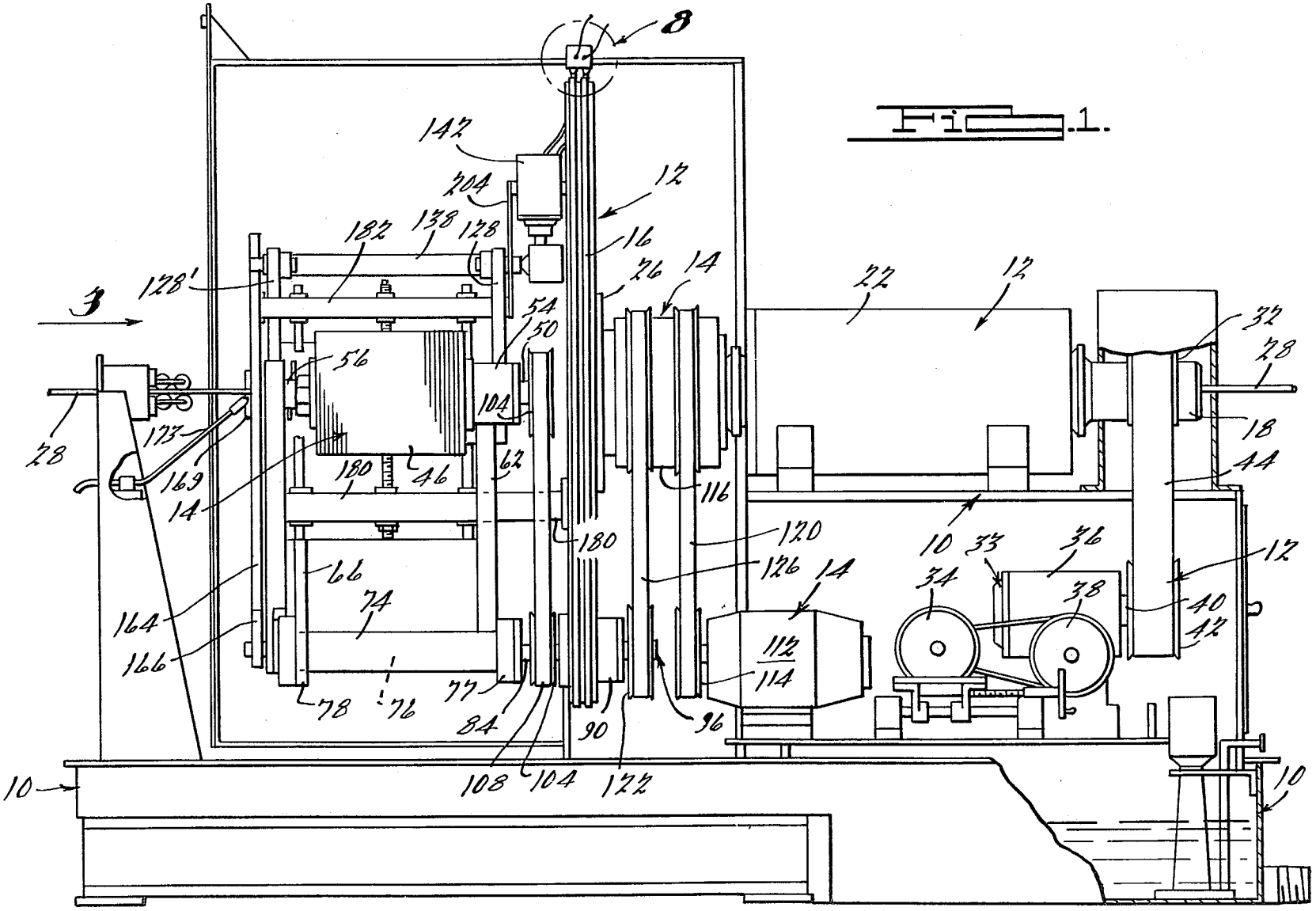
FIG. 1 is a side elevational view, with the cover removed, of the preferred embodiment of the planetary wire descaling machine of the present invention.

Referring to the drawings and referring particularly to FIGS. 1 to 6 thereof, a machine of the present invention is illustrated which includes a support generally indicated at 10 upon which the operating parts of the machine are mounted.

These operating parts include a planetary mounting plate and drive mechanism generally indicated at 12; and a pair of brush wheels of conventional and available construction, supporting mechanism for mounting the brushes on the planetary plates, and drive mechanism mounted on the support and operatively connected to drive the brushes, all generally indicated at 14.

Figure 2:
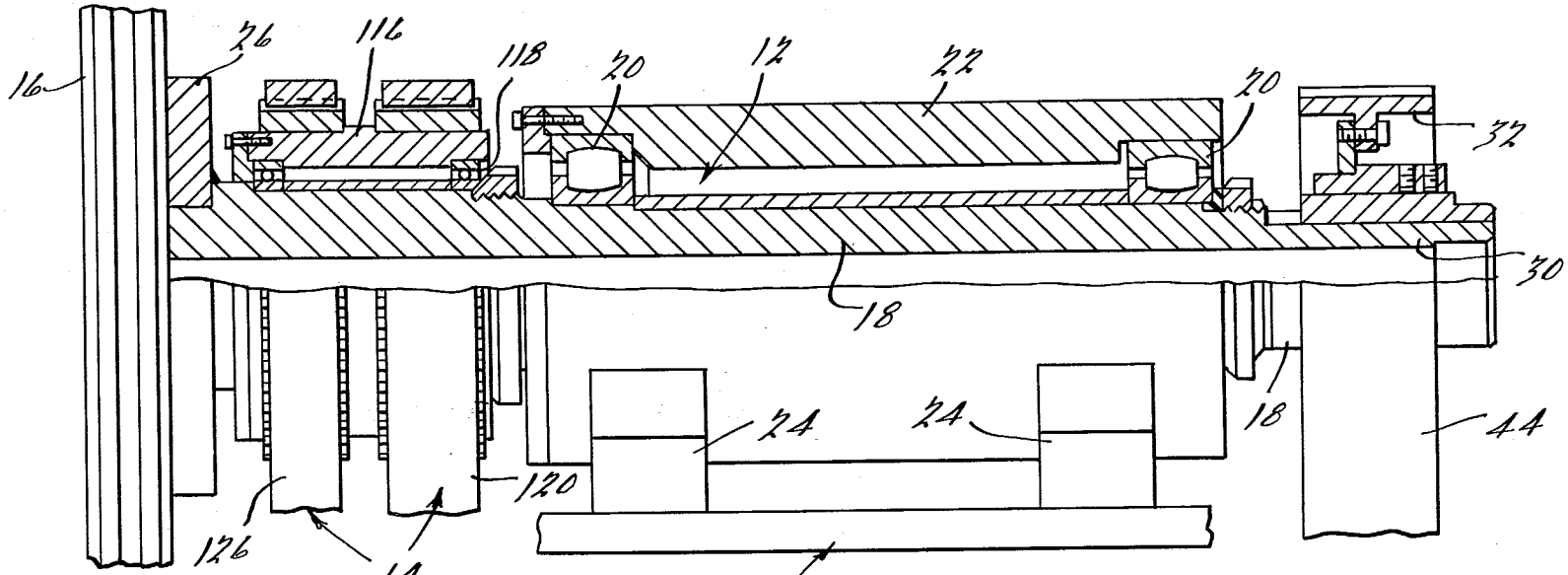
FIG. 2 is an enlarged partial side elevational view, with parts in cross-section of the planetary mounting disc with associated mounting and drive mechanism and a portion of the drive mechanism for the brush wheels.

The details of the planetary plate and drive system 12 are best illustrated in FIGS. 1 and 2. The system 12 includes a planetary mounting plate 16 of disc or circular configuration, which is mounted on the forward end of a main planetary spindle 18.

The spindle 18 is rotatably mounted by spaced bearings 20 fixed on a spindle housing 22 which in turn is supported on the support 10 (FIG. 2) by spaced brackets 24.

The forward end of the spindle 18 is fixed to the planetary disc by a mounting plate 26.

The spindle 18, disc 16 and mounting plate 26, all have aligned central openings therethrough through which the workpiece 28 passes as it is being processed.

The end of the spindle 18 projects rearwardly as indicated at 30. A sheave 32 is keyed to the projecting end 30 of the spindle 18.

A planetary drive unit 33 is mounted on the support 10 and includes an A.C. motor 34 connected to a gear box 36 through a conventional, mechanical variable speed pulley and belt mechanism 38.

The projecting shaft 40 of the gear box 36 has a sheave 42 keyed thereon which drives the sheave 32 and consequently the main planetary spindle 18 through a belt 44.

The details of brush wheels and their supporting and drive mechanisms 14 are best seen in FIGS. 1, 3, 4, 5, 6 and 9.

Figure 4:
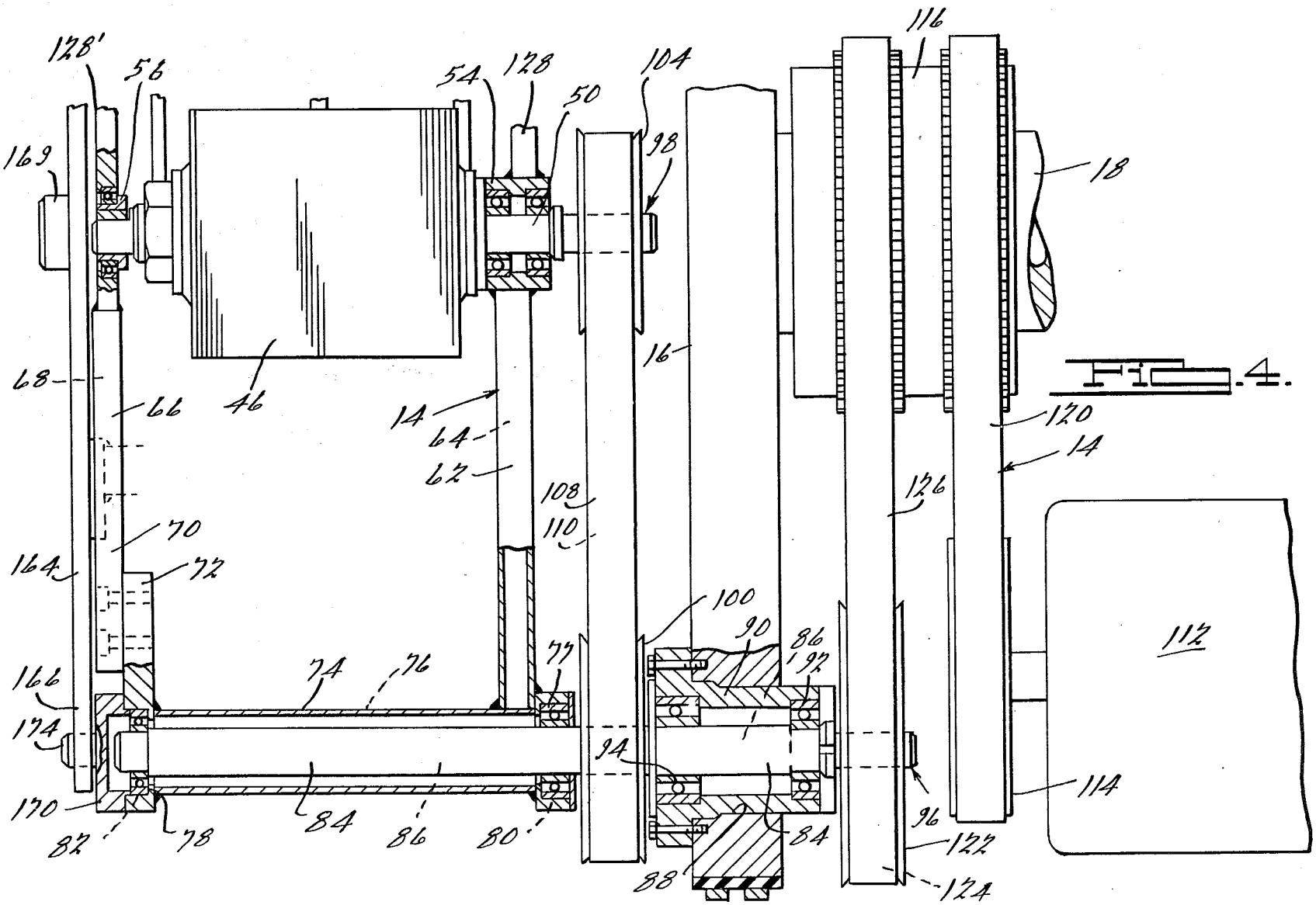
FIG. 4 is an enlarged partial side elevational view with part in cross-section of the brush wheels with associated mountings and drive mechanism.
Figure 5:
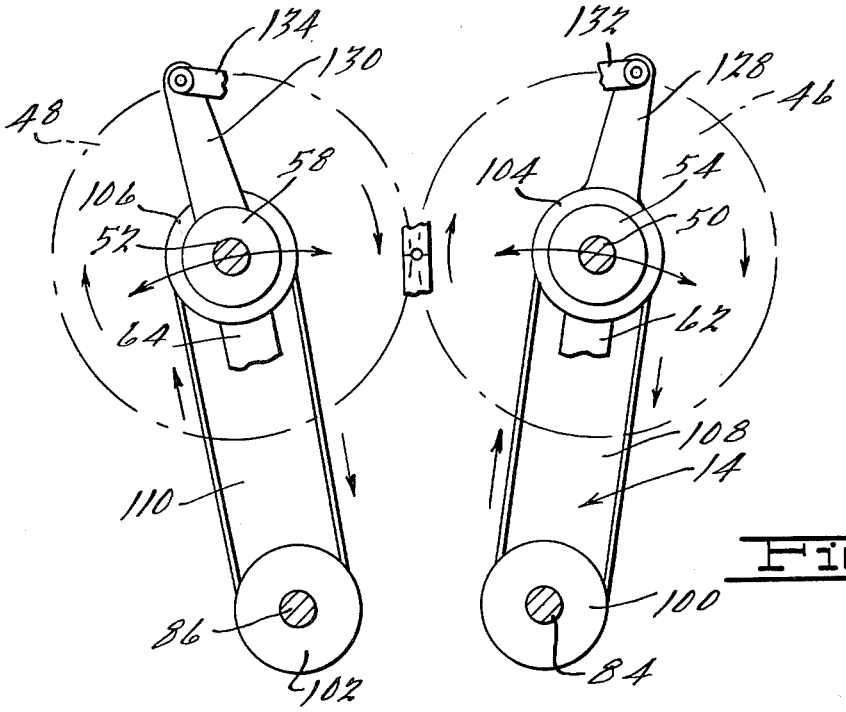
FIG. 5 is a partial, schematic view of a part of the drive mechanism for the brush wheels.
Figure 9:
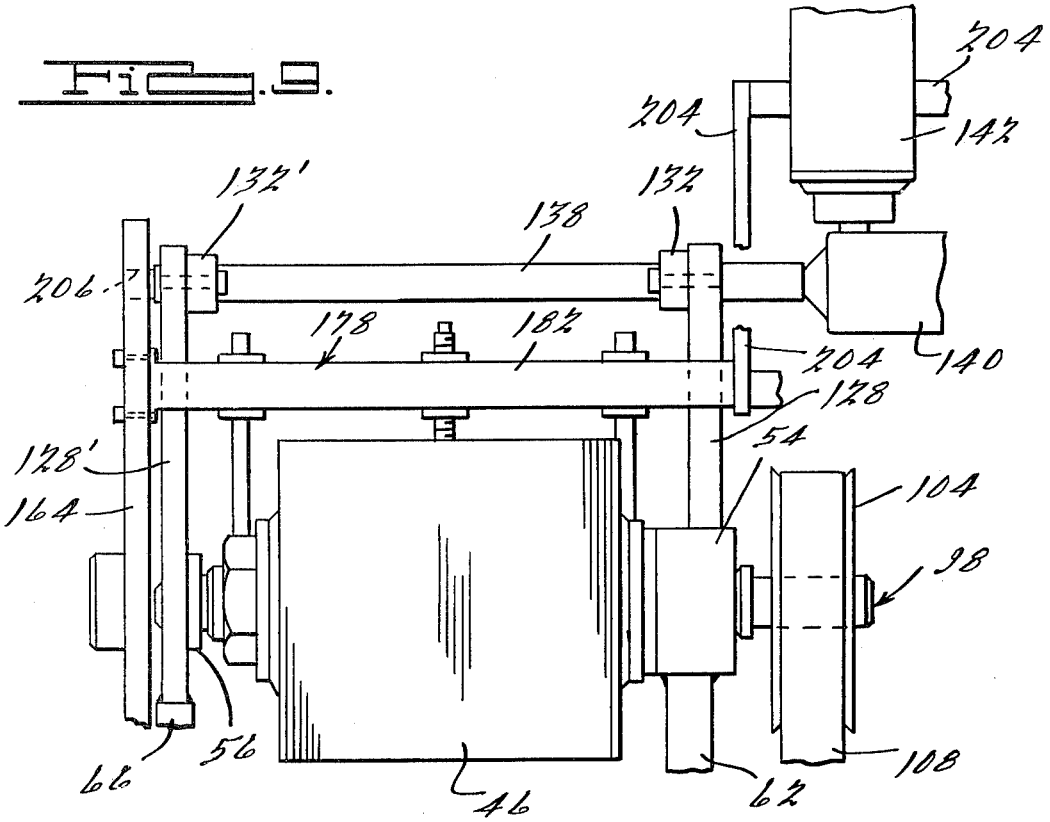
FIG. 9 is an enlarged view of a portion of brush mounting mechanisms shown in FIG. 1.

Such mechanism 14 includes a pair of circular brushes (of known construction) 46 and 48 which are mounted upon drive shafts 50 and 52, respectively. The drive shaft 50 is supported at its inner end within bearing assembly 54 and at its outer end within a bearing assembly 56. Similar bearings assemblies 58 and 60 support the inner and outer ends respectively of drive shaft 52 (FIGS. 4, 5 and 9).

The housings of bearing assemblies 54 and 58 are fixedly supported on the ends of arms 62 and 64, respectively; and the housings of bearings assemblies 56 and 60 are fixedly supported on the upper ends of arms 66 and 68, respectively. Arms 66 and 68 are each made in two separable parts 70 and 72 which are bolted together as shown in FIG. 4. Thus the upper parts of the arms 66 and 68 may be removed for ready application or removal of the brushes on their respective drive shafts.

The lower ends of arms 62 and 64 are fixed to the inner ends of housings 74 and 76, respectively, and the separate parts 72 of the arms 66 and 68 are fixed to the forward ends of housings 74 and 76, respectively.

Bearing assemblies 77 and 78 are supported on the rear and forward ends of housing 74 and corresponding bearing assemblies 80 and 82 are supported on the rear and forward ends of housing 76.

Drive spindles 84 and 86 are disposed in housings 74 and 76, respectively, and rotatably supported in bearings 76 and 78, and 80 and 82, respectively.

The shafts 84 and 86 project rearwardly through duplicate aligned openings 88 in the planetary disc 16 and are supported thereon for rotation therewith by duplicate bearing housings 90, one of such housings mounted in each opening 88.

Each housing 90 has spaced bearings 92 and 94 therein which rotatably mount the inner ends of shafts 84 and 86.

The housings 74 and 76 are thus rotatable with respect to shafts 84 and 86 and consequently the axes of the brush drive shafts are likewise rotatable toward and away from each other to adjust the brushes toward and away from each other.

The shafts 84 and 86 project through the planetary disc 16 and beyond the inner face thereof as illustrated by the arrow 96 (FIG. 4).

The ends of shafts 50 and 52 project rearwardly of the housings 54 and 58 toward the adjacent face of the disc 16 as illustrated by the arrow 98 (FIG. 4).

Sheaves 100 and 102 are keyed to shafts 84 and 86, respectively; and sheaves 104 and 106 are keyed on the projecting ends 98 of shafts 50 and 52; the sheaves 100 and 104 and the sheaves 102 and 106, being aligned and drivingly connected by belts 108 and 110, respectively.

Belt and pulley means are provided for driving the brushes 46 and 48 through the pulleys 100 and 102, belts 108 and 110 and pulleys 104 and 106 from a single motor 112. Such drive motor 112 is mounted on the support 10 and has a pulley 114 mounted on the projecting end of the motor drive shaft (FIGS. 1 and 4).

Figure 6:
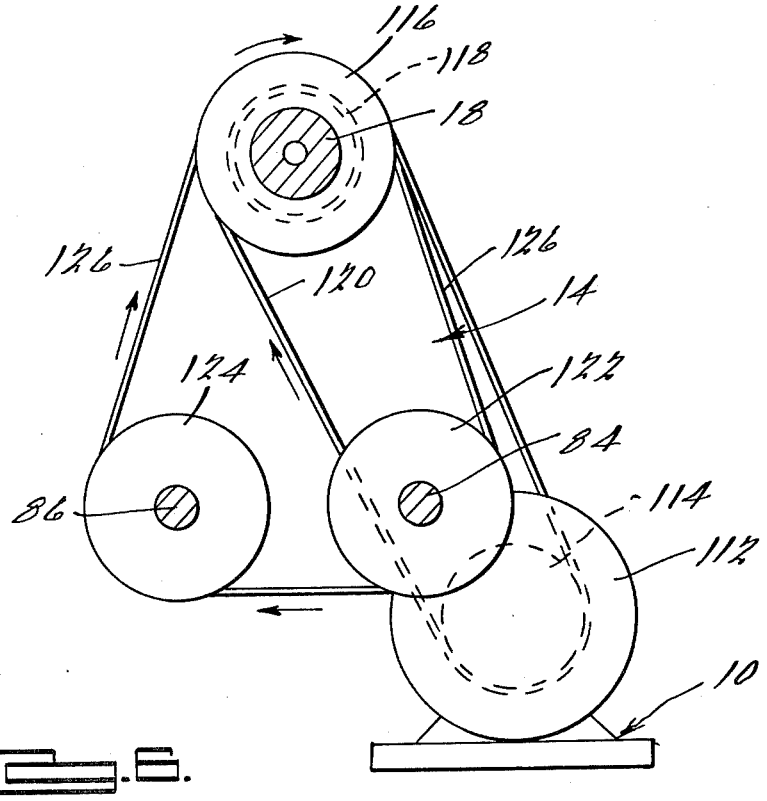
FIG. 6 is a partial, schematic view of another part of the drive mechanism for the brush wheels.

A double or companion sheave 116 of the gear type is rotatably mounted on a bearing assembly 118 on the main planetary spindle 118 in the space between the main spindle housing 22 and the planetary mounting plate 16 (FIGS. 2 and 6). The pulley 114 is connected to one of the gear pulleys of the companion sheave 116 by a belt 120.

Pulleys 122 and 124 are keyed to the projecting ends of shafts 84 and 86, respectively, at the region indicated by the arrow 96 (FIGS. 4 and 6). Companion sheave 116 is connected to sheave 122 and 124 through belt 126.

Thus the brush drive shafts 50 and 52, and their associated brushes 46 and 48 are driven by the single motor 112 through sheave 114, belt 120, companion sheave 116, belt 126, sheaves 122 and 124, driven shafts 84 and 86, sheaves 100 and 102 on shafts 84 and 86, belts 108 and 110, sheaves 104 and 106 which are connected to the drive shafts 50 and 52. This chain of drive is best illustrated in FIGS. 5 and 6.

The brushes rotate in opposite directions as shown by the arrows in FIG. 5. These are the preferred directions of rotation. However, it may be desirable to have the brushes rotate in the same direction which can readily be accomplished by modifying the drive belt arrangement. Also at times it may be desirable to drive only one brush and employ a back-up brush on the opposite shaft.

In the mechanism so far described, the planetary mounting plate is driven by the motor 34 through the drive mechanism generally indicated at 12 and the brushes which are mounted on the planetary plate for rotations therewith are independently driven for rotation about their own axes by the drive mechanism generally indicated at 14.

The shafts 50 and 52 may be pivoted on their mounting arms 62 and 64 and 66 and 68, respectively, and housings 74 and 76, respectively, about shafts 84 and 86 so that the brushes 46 and 48 may be adjusted toward or away from each other.

Figure 3:
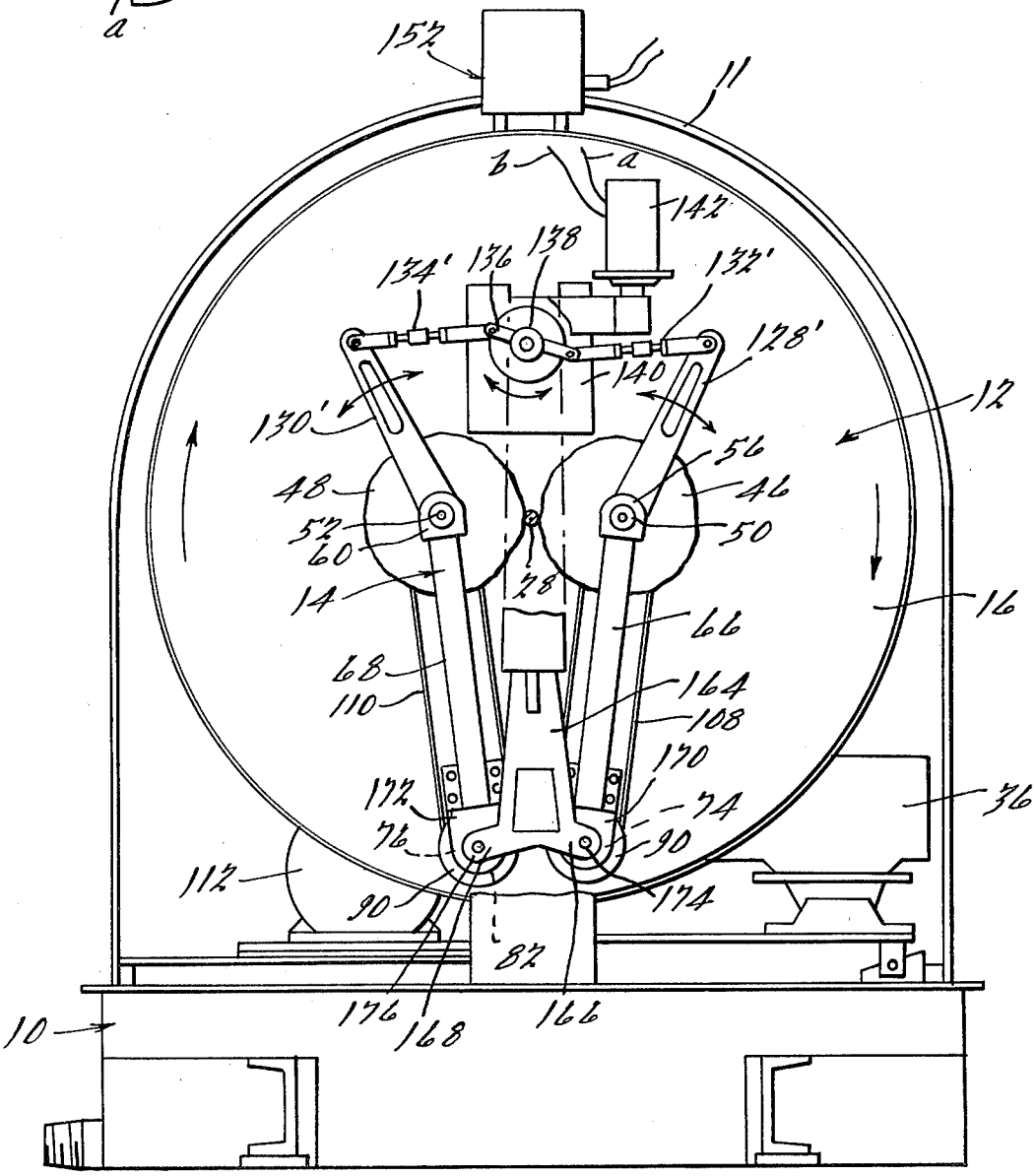
FIG. 3 is an end elevational view of the machine taken substantially in the direction of the arrow 3 in FIG. 1, and with the end cover open.

To effect this adjustment and maintain the brushes in adjusted spaced relationships, mechanism is provided as seen in FIGS. 3, 5 and 9. Upwardly projecting arms 128 and 130 are fixed to the inner bearing housings 54 and 58 respectively; and upwardly projecting arms 128' and 130' are fixed to the outer bearing housings 56 and 60, respectively. The upper ends of the inner arms 128 and 130 are pivotally connected to the opposite outer ends of adjustable links 132 and 134, respectively; and the upper ends of arms 128' and 130' are pivotally connected to the outer ends of adjustable links 132' and 134', respectively. The inner ends of such links are pivotally connected to the opposite ends of a crank arm 136 and 136', respectively, which are connected to and rotated by a drive shaft 138 from a gear box 140. The drive shaft 138 and crank arms 136 and 136' may be rotated in either direction to cause the arms 128 and 128' and 130 and 130' and consequently the brushes 46 and 48, to move toward and away from each other and to be held in adjusted position.

The shaft 138 is rotated by a D.C. motor 142 which is drivingly connected thereto through the gear box mechanism 140. The gear box 140 and motor 142 are mounted on the face of planetary plate 16 for rotation therewith.

Figure 8:
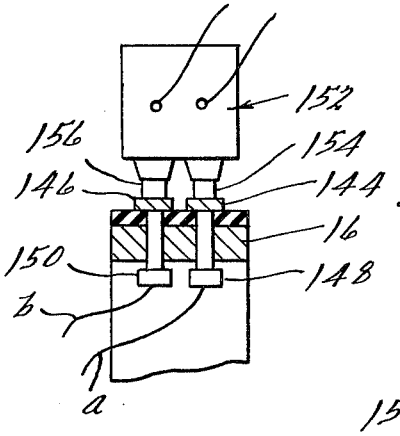
FIG 8 is an enlarged view within the circle 8 of FIG. 1.
Figure 7:
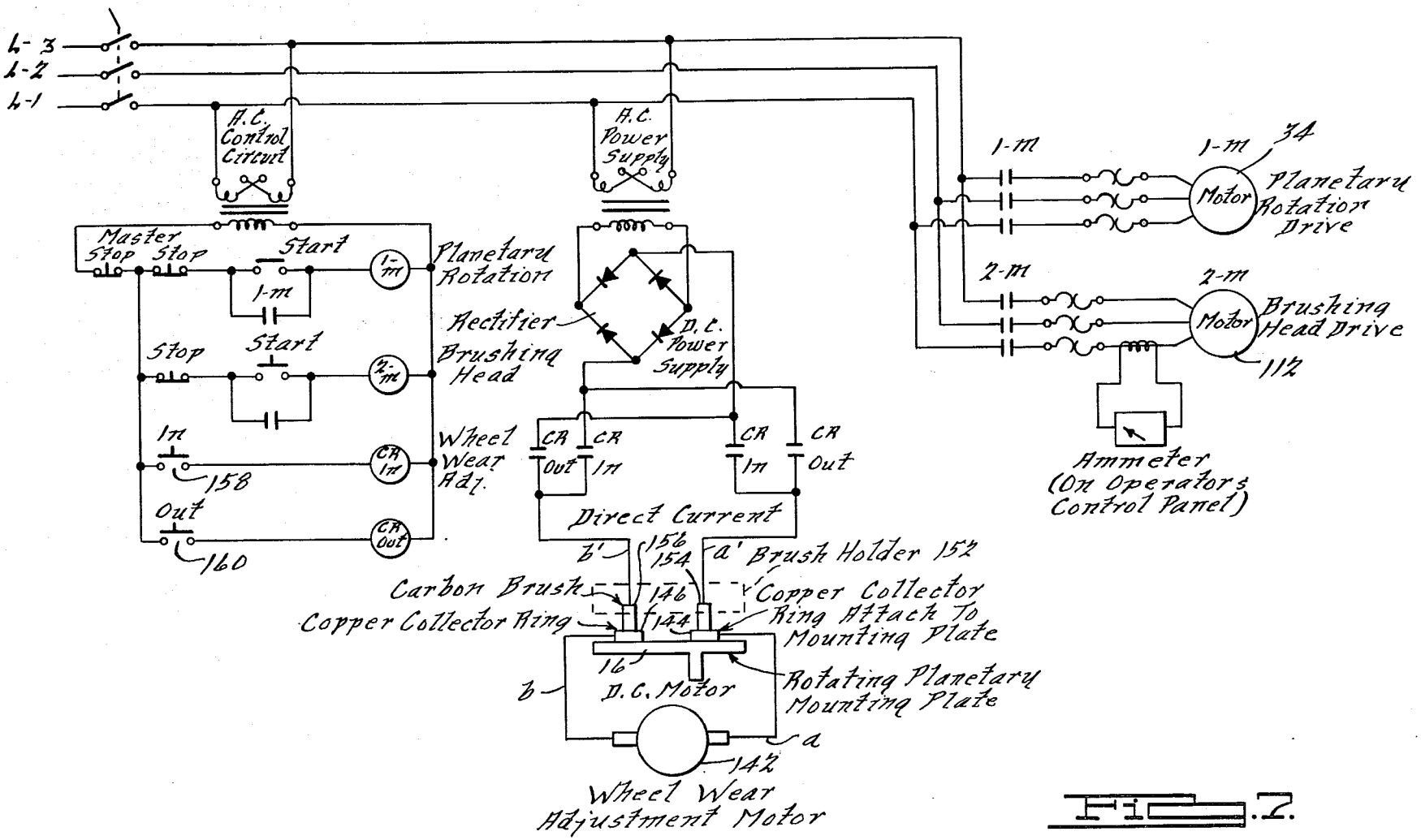
FIG. 7 is a diagrammatic electric circuit for the machine of the present invention employing conventional electric designations.

The motor 142 is excited through the electric circuit illustrated in FIG. 7 and by the mechanism shown in FIGS. 1, 3 and 8. Copper collector rings 144 and 146 are mounted on the periphery of the planetary plate 16 and electrically insulated therefrom (FIG. 8). The motor 142 is connected to the rings 144 and 146 by wires a and b through contacts 148 and 150.

A bush holder box 152 is mounted on the housing 11 of the support 10 adjacent the periphery of the plate 16 with inwardly directed contact brushes 154 and 156 which engage collector rings 144 and 146 during rotation of the planetary plate 16.

The current from the brushes 154 and 156 is connected into the electric circuit through wires a' and b' (FIG. 7).

An ammeter (FIG. 7), which may be mounted on the operator's control panel or otherwise visable to the operator, is connected into the brush head drive motor circuit and indicates the load or resistance on the brushes, thus indicating brush wear, or the need for adjusting the brushes for proper processing of the wire, and signaling to the operator the need for adjustment.

"In" button 158 and "out" button 160 are illustrated in the circuit FIG. 7. Following the circuit it will be evident that with the "in" button 158 closed, the circuit will cause the motor 142 to operate in one direction to cause the crank to turn in one direction (clockwise FIG. 3) to bring the brushes closer together. Closing the "out" button 160 will have the reverse effect i.e., causing the crank to turn in the opposite direction (counterclockwise, FIG. 3) to move the brushes farther apart. This may be accomplished without stopping the machine.

In order to support the outer ends of the wheel drive shafts 84 and 86, and therefore provide an outboard support for the brushes 46 and 48, an outboard support plate 164 is provided. The plate 164 has a pair of oppositely spreading arms 166 and 168 at the lower end (FIG. 3) the outer ends of the arms having transverse openings therethrough. Covers 170 and 172, for covering the ends of the housings 74 and 76 are fixed to the ends 72 of the arms 66 and 68 and have projecting pins 174 and 176 which are received through the opening in arms 166 and 168 to support one end of the outboard support plate 164.

The opposite end of the outboard plate 164 is removably bolted to the end of the frame of a wire guide and support means 178 to be described herebelow.

The plate 164 has a guide bushing 169 mounted thereon which has an opening therethrough for receiving and properly locating the wire 28 with respect to the brushes and the planetary plate 16. A conventional three jaw adjustable roller guide 171 is mounted on the frame for guiding the workpiece to the machine. Also, a conventional coolant spray nozzle 173 may be provided and connected to a pump in the usual way.

Figure 10:
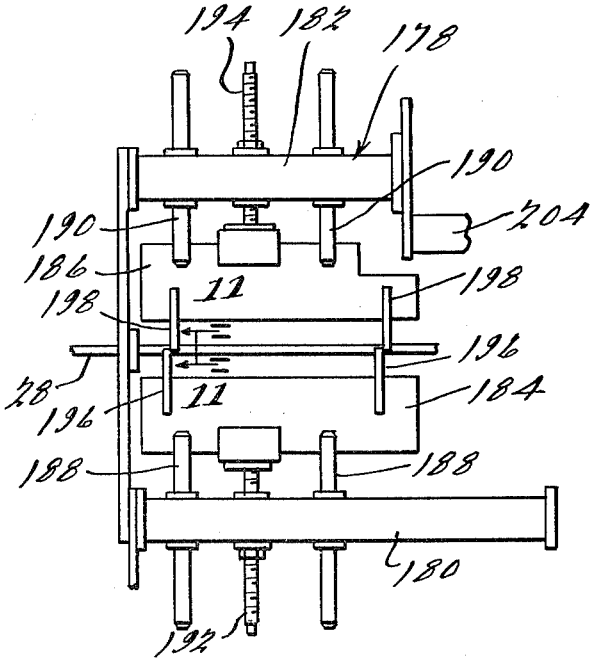
FIG. 10 is an enlarged elevational view of the adjustable wire guide and support mechanism shown in FIG. 1.
Figure 11:
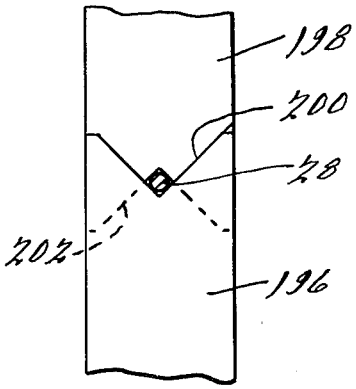
FIG. 11 is an enlarged elevational view of the wire guide elements in the direction of the arrow 1 through 11 of FIG. 10.

The adjustable wire guide and support means is generally indicated at 178 and best shown in FIGS. 9, 10 and 11. The guide and support means is adjustable so that it may receive workpieces of different diameters.

The support means 178 consists of pairs of parallel mounting frame members 180 and 182. Plate members 184 and 186 are adjustably mounted on their respective members 180 and 182 by guide pins 188 and 190 and adjustment screws 192 and 194 (FIG. 10). Spaced pairs of facing and overlapping guide and support plates 196 and 198 are fixed to the plates 184 and 186, respectively. The facing ends of the plates 196 and 198 are formed with overlapping V-grooves 200 and 202, respectively; and it is evident that by adjusting the plates 196 and 198 toward or away from each other different diameters of wire workpieces may be accommodated.

The support 178 is fixed to the planetary disc 16 so that the guides are diametrically opposed between the bight of the brushes 46 and 48 and for rotation with the disc 16. To accomplish this, the frame member 180 projects against the surface of the disc 16 and is welded thereto (FIG. 1). The frame member 182 is also fixed to the disc 16 by an off-set frame member 204 which has one end fixed to the inner end of member 182 and the other off-set end fixed to the disc 16. The off-set frame 204 is required to get around or clear other elements supported on the face of disc 16.

Thus the frame 178 is secured to the disc 16 for rotation therewith. The secured frame 178 serves another function in that it supports the end of the outboard support 164 opposite to the end having the diverging positions 174 and 176 (FIG. 3). This other end of the support 164 is bolted to the adjacent end of the frame member 182 (FIG. 9). The end of the support 164 projects beyond the frame member 182 and has an opening 206 therethrough which rotatably supports a reduced end of the drive shaft 138.

I claim:

1. A machine for removing scale, or the like, from the surface of wire, rod, tube or like workpiece comprising:

a support;

a planetary plate member having a central opening therethrough;

means mounting said plate member on said support;

primary drive means including an electric motor mounted on said support and connected to said plate member by belt drive for rotating said plate member;

a pair of opposed unitary and circular brush members;

brush mounting means for mounting said brush members on said plate member for rotation therewith about the axis of rotation of said plate member and for independent rotation thereon about their respective axes;

said brush mounting means including a brush drive shaft mounting each brush member, each brush drive shaft being mounted in bearing assemblies adjacent opposite ends thereof, a pair of separate housing members spaced from and substantially parallel to each of said brush drive shafts, rigid arms interconnecting the opposite ends of each of said housing members with said bearing assemblies respectively, a second drive shaft mounted within bearings within each of said housing members, means rotatably mounting each of said housing members on said plate member, belt drive means connected to said second drive shafts and to said brush drive shafts;

second drive means including a single electric motor mounted on said support and connected to said belt drive means by belt drives for independently rotating said brush members;

means guiding said workpiece between opposing faces of said brushes and through said central opening of said planetary plate member.

2. A machine according to claim 1 in which the brush mounting means support the brush drive shafts and therefore the brushes for movements toward and away from each other, movable means operatively interconnecting the brush mounting means, and synchronous means operating said last named means to uniformly adjust the work pressure of the respective brushes by adjusting the brush drive shafts and therefor the brushes toward and away from each other.

3. A machine according to claim 2 in which the synchronous means is operated without stopping the operation of said primary drive means or said secondary drive means.

* * * * *